US006387538B1

(12) United States Patent
Lee et al.

(10) Patent No.: US 6,387,538 B1
(45) Date of Patent: May 14, 2002

(54) SURFACE-TREATED STEEL SHEET FOR FUEL TANKS AND METHOD OF FABRICATING SAME

(75) Inventors: Jae-Ryung Lee; Sang-Geol No; Soo-Hyoun Cho; Youn-Kyun Song; Sam-Kyu Chang, all of Kyungsangbuk-do (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/554,023

(22) PCT Filed: Nov. 30, 1999

(86) PCT No.: PCT/KR99/00722

§ 371 Date: May 8, 2000

§ 102(e) Date: May 8, 2000

(87) PCT Pub. No.: WO00/32843

PCT Pub. Date: Jun. 8, 2000

(30) Foreign Application Priority Data

| | | |
|---|---|---|
| Dec. 1, 1998 | (KR) | 98-52143 |
| Dec. 2, 1998 | (KR) | 98-52504 |
| Dec. 3, 1998 | (KR) | 98-52839 |
| Dec. 14, 1998 | (KR) | 98-54829 |

(51) Int. Cl.[7] ..... B32B 15/04; C23C 22/33; C25D 7/06

(52) U.S. Cl. ..... 428/632; 148/258; 148/264; 148/265; 148/267; 148/284; 205/155; 205/246; 205/305; 428/623; 428/626; 428/546; 428/659; 428/681; 428/413; 428/423.1; 428/472; 428/524; 428/697; 428/702; 428/926; 428/935

(58) Field of Search ..... 428/623, 626, 428/632, 546, 659, 681, 413, 423.1, 472, 524, 697, 702, 926, 935; 148/258, 264, 265, 267, 284; 205/155, 246, 305; 106/287.23, 287.24, 287.34

(56) References Cited

U.S. PATENT DOCUMENTS

| | | | | |
|---|---|---|---|---|
| 4,907,099 A | | 3/1990 | Nagai et al. | 360/10.2 |
| 5,330,850 A | | 7/1994 | Suzuki et al. | 428/623 |
| 5,397,638 A | | 3/1995 | Miki et al. | 428/328 |
| 6,149,735 A | * | 11/2000 | Oue et al. | 148/267 |

FOREIGN PATENT DOCUMENTS

| | | |
|---|---|---|
| JP | 63019981 | 1/1988 |

(List continued on next page.)

*Primary Examiner*—Robert R. Koehler
(74) *Attorney, Agent, or Firm*—Baker Botts LLP

(57) ABSTRACT

A surface-treated sheet for fuel tanks includes a cold-rolled steel sheet with a low carbon content, a zinc or zinc-based alloy plating layer formed on the steel sheet, and a chromate film coated on the zinc or zinc-based alloy plating layer. The chromate film is formed from a chromate solution. The chromate solution includes a subject solution and an aqueous silane solution in an amount ranging from 5 to 50% by weight of the subject solution. The subject solution contains a chrome aqueous solution where the concentration of chrome is in the range of 5–50 g/l and the ratio of trivalent chrome to the chrome content is in the range of 0.4 to 0.8. Phosphoric acid in an amount ranging from 20 to 150% by weight with respect to the chrome content, fluoric acid in an amount ranging from 10 to 100% by weight with respect to the chrome content, colloidal silica having pH of 2–5 in an amount ranging from 50 to 2000% by weight with respect to the chrome content, and sulfuric acid in an amount ranging from 5 to 30% by weight with respect to the chrome content are mixed with the chrome aqueous solution. The aqueous silane solution contains 2–10 wt % of Epoxy-based silane and has a pH of 2–3. A resin coating layer is formed on one side or both sides of the chromate film. The resin coating layer is formed from a resin solution. The resin solution includes a phenoxy resin solution having a molecular weight of 25,000–50,000, colloidal silica of 10–20 phr with respect to the phenoxy resin content, and melamine resin of 2–15 phr with respect to the phenoxy resin content.

31 Claims, 2 Drawing Sheets

FOREIGN PATENT DOCUMENTS

| | | |
|---|---|---|
| JP | 63069361 | 3/1988 |
| JP | 02018982 | 1/1990 |
| JP | 05065676 | 3/1993 |
| JP | 09059783 | 3/1997 |
| KR | 97703448 | 7/1997 |
| WO | WO 97/21845 A2 * | 6/1997 |

* cited by examiner

SURFACE-TREATED STEEL SHEET FOR FUEL TANKS AND METHOD OF FABRICATING SAME

BACKGROUND OF THE INVENTION (a) Field of the Invention

The present invention relates to a surface-treated steel sheet for fuel tanks and a method of fabricating the same and, more particularly, to a surface-treated steel sheet which is well adapted for use in forming fuel tanks while exhibiting good performance characteristics in chemical resistance, corrosion resistance and weldability.

(b) Description of the Related Art

Generally, it is required that a steel sheet for fuel tanks should has resistance to corrosion on its outer surface to be exposed to the atmosphere (hereinafter referred to as the "cosmetic corrosion resistance") as well as resistance to corrosion on its inner surface to contact fuel such as gasoline (hereinafter referred to as the "fuel corrosion resistance").

A fuel tank is usually made by press-forming steel sheets into cup-shaped upper and lower tank bodies, and welding the bodies to each other by spot welding, seam welding, soldering, or brazing. In this respect, good weldability is also required for the steel sheet to be applied for use in forming fuel tanks.

A ternesheet that is a lead-tin (Pb—Sn) alloy plated steel sheet has widly used as such a steel sheet for fuel tanks. However, the ternesheet should have been limited in its use because it contains lead (Pb) harmful to the human body. In this connection, extensive researches have been made to develop a surface-treated steel sheet for fuel tanks without any lead content.

Japanese Patent Laid Open Publication No. Sho63-19981 discloses a surface-treated steel sheet where a steel sheet is overlaid with a zinc (Zn) plating layer and a chromate film. However, such a chromate film has poor fuel corrosion resistance so that the zinc content of the zinc plating layer elutes and generates white rusts. The white rusts are floating in fuel and cloak the fluid flowing paths such as a filter.

Japanese Patent Laid Open Publication Nos. Sho63-69361 and Hei2-18982 disclose another kind of surface-treated steel sheet where a steel sheet is overlaid with a zinc or zinc-based alloy (Zn—Ni, Zn—Co, Zn—Fe or Zn—Al) plating layer, and an organic resin coating layer. The organic resin coating layer is formed with phenoxy resin, epoxy and metallic powder. The amount of deposition of the zinc or zinc-based alloy is 200 g/m$^2$ and that of the organic resin is 50 $\mu$m. As such large amount of deposition causes for the resulting resin coating layer to be too thick, adherence of the resin coating layer to the plating layer is weakened so that they are liable to be desquamated from each other. Furthermore, such a structure is not cost effective while bearing poor chemical resistance and poor corrosion resistance.

Korean Patent Application No. 97-703448 and Japanese Patent Laid Open Publication No. Hei9-59783 disclose still another kind of surface-treated steel sheet where a steel sheet is overlaid with a zinc-nickel (Zn—Ni) alloy plating layer and a chromate film. The chromate film is formed from a chromate solution containing resin and silica. Minute cracks are formed on the zinc-nickel alloy plating layer to enhance corrosion resistance, but such crack formation bears complicated processing steps. Furthermore, in such a structure, the chrome content is liable to elute even in contact with minimum amount of water to be contained in fuel, and this results in deteriorated fuel corrosion resistance.

Accordingly, there is a need for developing a surface-treated steel sheet for fuel tanks that satisfy all the requirements of weldability, formability, cosmetic corrosion resistance, and fuel corrosion resistance at the same time.

SUMMARY OF THE INVENTION

It is an object of the present invention to provide a surface-treated steel sheet which is well adapted for use in forming fuel tanks while exhibiting good physicochemical characteristics.

This and other objects may be achieved by a surface-treated steel sheet including a cold-rolled steel sheet with a low carbon content, a zinc or zinc-based alloy plating layer formed on the steel sheet, and a chromate film coated on the zinc or zinc-based plating layer. The chromate film is formed from a chromate solution. The chromate solution includes a subject solution containing a chrome aqueous solution where the ratio of trivalent chrome to the chrome content is in the range of 0.4–0.8 and the concentration of chrome is in the range of 7–50 g/l. Phosphoric acid in an amount ranging from 20 to 150% by weight with respect to the chrome content, fluoric acid in an amount ranging from 10 to 100% by weight with respect to the chrome content, colloidal silica having pH of 2–5 in an amount ranging from 50 to 2000% by weight with respect to the chrome content, and sulfuric acid in an amount ranging from 5 to 30% by weight with respect to the chrome content are mixed with the chrome aqueous solution. An aqueous solution in an amount ranging from 5 to 50% by weight with respect to the subject solution is added to the subject solution. The aqueous solution contains Epoxy-based silane in an amount ranging from 5 to 50% by weight with respect to the hardening solution and has a pH of 2–3. The amount of chrome (Cr) in the chromate film is in the range of 20–250 mg/m$^2$.

A resin coating layer may be formed on one side or both sides of the chromate film. The resin coating layer is formed from a resin solution. The resin solution includes a phenoxy resin solution having a molecular weight of 25,000–50,000, colloidal silica of 10–20 phr with respect to the phenoxy resin content, and melamine resin of 2–15 phr with respect to the phenoxy resin content.

The chromate film and the resin coating layer are all to improve cosmetic corrosion resistance and fuel corrosion resistance of the surface-treated steel sheet. With the addition of appropriate amount of para toluene sulfonic acid (p-TSA), wax and metallic powder to phenoxy resin, the physicochemical characteristics of the surface-treated steel sheet may be further improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Figure 1A:
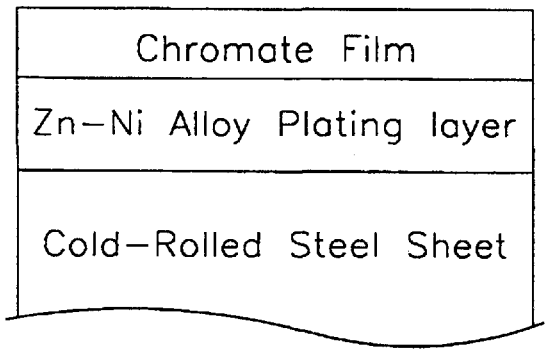
FIG. 1A is a cross section view of a surface-treated steel sheet for fuel tanks according to one aspect of the present invention.
Figure 1B:
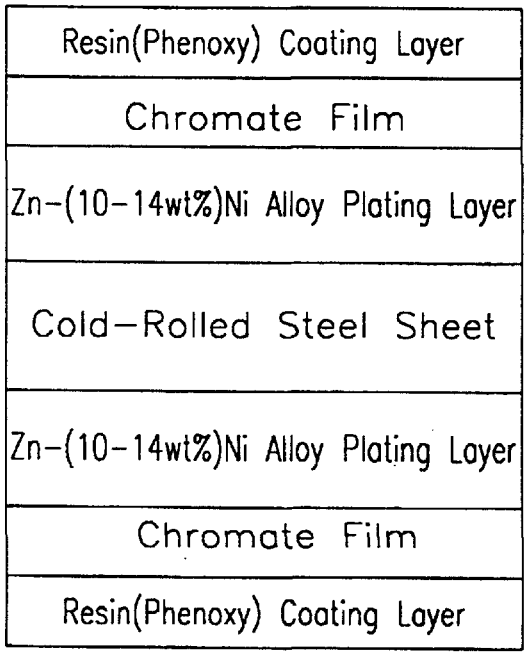
FIG. 1B is a cross section view of a surface-treated steel sheet for fuel tanks according to another aspect of the present invention.
Figure 1C:
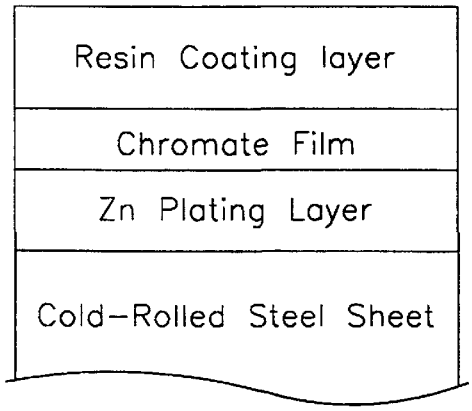
FIG. 1C is a cross section view of a surface-treated steel sheet for fuel tanks according to still another aspect of the present invention.

FIG. 1A illustrates a layered structure of a surface-treated steel sheet according to one aspect of the present invention where a cold-rolled steel sheet is sequentially overlaid with a zinc-nickel (Zn—Ni) alloy plating layer, and a chromate film. FIG. 1B illustrates a layered structure of a surface-treated steel sheet according to another aspect of the present invention where a cold-rolled steel sheet is sequentially overlaid with a zinc-nickel (Zn—Ni) alloy plating layer, a chromate film, and a resin coating layer. FIG. 1C illustrates a layered structure of the surface-treated steel sheet according to still another aspect of the present invention where a cold-rolled steel sheet is sequentially overlaid with a zinc (Zn) plating layer, a chromate film, and a resin coating layer.

The surface-treated steel sheet according to the present invention may be selectively formed with any one layered structure shown in FIGS. 1A to 1C.

According to the needs of the consumer, the resin coating layer of the surface-treated steel sheet may be formed on either one side or both sides of the cold-rolled steel sheet. In case a pair of surface-treated steel sheets each with one-sided resin coating layer are welded to each other to form a fuel tank, the resin coating layer faces inward such that it contacts fuel to be fed into the resulting fuel tank. In this case, the outer surface of the surface-treated steel sheet without any resin coating layer may be additionally coated with melamine or PVC to strengthen cosmetic corrosion resistance or to buff external impacts.

The method of fabricating such a surface-treated steel sheet will be now described in detail.

Cold-rolled steel sheet

Low-carbon steel sheet having less or 0.03% of carbon content is used as the cold-rolled steel sheet.

Formation of Zinc (Zn) or Zinc-based Alloy Plating Layer

Zinc (Zn), zinc-nickel (Zn—Ni) alloy, zinc-cobalt (Zn—Co) alloy, zinc-manganese (Zn—Mn) alloy or zinc-chrome (Zn—Cr) alloy may be used as the plating material. In present invention, a zinc (Zn) plating layer or a zinc-nickel (Zn—Ni) alloy plating layer is preferably used as the plating material. Various techniques may be employed for the plating. An electroplating technique is preferably used because it is easily controlled and, after plating, makes it possible for the resulting layer to bear relatively good surface properties.

The zinc-nickel (Zn—Ni) alloy plating layer preferably contains 10–14 wt % of nickel (Ni) content. This range makes it possible for the plating layer to bear good formability and corrosion resistance.

The amount of deposition of zinc-nickel (Zn—Ni) alloy is preferably in the range of 10–40 g/m$^2$. When the amount is smaller than 10 g/m$^2$, the resulting layer exhibits poor corrosion resistance. In contrast, when the amount is larger than 40 g/m$^2$, the layer desquamates from the cold-rolled steel sheet at press forming, and powdering is generated, resulting in poor productivity. It can be easily noted that as the amount of deposition is larger, the consumption power increases as much in welding process.

The amount of deposition of zinc (Zn) is preferably in the range of 20–80 g/m$^2$. When the amount is smaller than 20 g/m$^2$, the resulting layer exhibits poor corrosion resistance. In contrast, when the amount is larger than 80 g/m$^2$, the layer desquamates from the steel sheet at press forming, and powdering is generated.

Formation of Chromate Film

The chromate film is to enhance corrosion resistance without forming any cracks on the zinc or zinc-based alloy plating layer as well as to secure adherence of the resin coating layer to the plating layer.

The chromate solution for the chromate film is prepared by mixing an aqueous epoxy-based silane solution with a subject solution containing a chrome aqueous solution, phosphoric acid, fluoric acid, colloidal silica and sulfuric acid. In the mixture, the silane solution has a role of a hardening agent.

The chrome aqueous solution is prepared by dissolving chromic anhydride in distilled water, and adding ethylene glycol thereto such that the ratio of the insoluble trivalent chrome to the chrome content is in the range of 0.4–0.8. When the ratio is lower than 0.4, it becomes difficult to achieve the desired corrosion resistance, and the chrome content is liable to elute due to increase of the soluble hexavalent chrome ions $Cr^{+6}$. In contrast, when the ratio is higher than 0.8, the resulting aqueous solution is shifted into a gel state, and becomes inappropriate for use.

In case the chromate solution is applied onto the zinc or zinc-based alloy plating layer by roll coating, the concentration of the chrome aqueous solution is preferably in the range of 5~50 g/l. When the concentration is lower than 5 g/l, the desired amount of attachment of chrome cannot be obtained even in the optimized coating condition. When the concentration is higher than 50 g/l, the chromate solution does not well spread onto the zinc or zinc-based alloy plating layer at roll coating, resulting in a non-uniform chromate film.

Phosphoric acid is added to the chrome aqueous solution to improve the surface physical property of the resulting chromate film. The amount of addition of phosphoric acid is preferably in the range of 20–150 wt % with respect to the chrome content of the chrome aqueous solution. When the amount is smaller than 20 wt % , the desired improvement of the surface physical property of the resulting film is not effected. In contrast, when the amount is larger than 150 wt % , the ratio of the insoluble trivalent chrome ions $Cr^{+3}$ increases, causing impairment in storage characteristic of the chromate solution as well as in corrosion resistance of the resulting film.

Fluoric acid is added to the chrome aqueous solution to enhance corrosion resistance and smoothness of the resulting chromate film. The amount of addition of fluoric acid is preferably in the range of 10–100 wt % with respect to the chrome content. When the amount is smaller than 10 wt %, the desired improvement of corrosion resistance is not satisfactorily effected. In contrast, when the amount is larger than 100 wt % , sludge is generated in the chromate solution, deteriorating stability of the chromate solution.

Colloidal silica having pH of 2–5 is added to the chrome aqueous solution to form crosslinks at the resulting chromate film at baking and prohibit zinc oxidation reaction in the steel sheet. Furthermore, as colloidal silica is hydrophobic, it improves corrosion resistance against water as well as adherence of the resulting film to the zinc or zinc-based alloy plating layer. The amount of addition of colloidal silica is preferably in the range of 50–2000 wt % with respect to the chrome content. When the amount is smaller than 50 wt % , the desired effects cannot be expected. In contrast, when the amount is larger than 2000 wt % , stability of the chromate solution as well as adherence of the resulting chromate film to the plating layer is impaired.

Sulfuric acid is added to the chrome aqueous solution to control colors of fluid and improve flowing of the fluid. The amount of addition of sulfuric acid is preferably in the range of 5–30 wt % with respect to the chrome content. When the amount is smaller than 5 wt %, the desired effect cannot be expected. In contrast, when the amount is larger than 30 wt % , stability of the chromate solution as well as corrosion resistance of the resulting film is deteriorated.

The epoxy-based silane solution for the hardening agent is prepared by adding epoxy-based silane into distilled water by 2–10 wt % with respect to all the hardening solution while controlling pH of the solution to be 2–3 that is the same as that of the subject solution. The pH controlling is to prevent the chromate solution from being shifted into a gel state. Such a pH controlling may be performed in various ways. It is preferable that the pH should be controlled by adding phosphoric acid.

When the epoxy-based silane solution is mixed with the subject solution, the amount of the former is preferably in the range of 5–50 wt % with respect to the latter. When the amount is smaller than 5 wt %, crosslinking reaction does not sufficiently occur. In contrast, when the amount is larger than 50 wt %, stability of the chromate solution is lowered.

When the prepared chromate solution is applied onto the zinc or zinc-based alloy plating layer, the application type may be reaction, electrolysis or coating. As, in the reaction process, the zinc-nickel (Zn—Ni) alloy plating layer is electrochemically less reactant with the chromate solution, the coating type is preferably employed for use in such an application. The coating process is performed by using a triple roll coater shown in FIG. 2.

Figure 2:
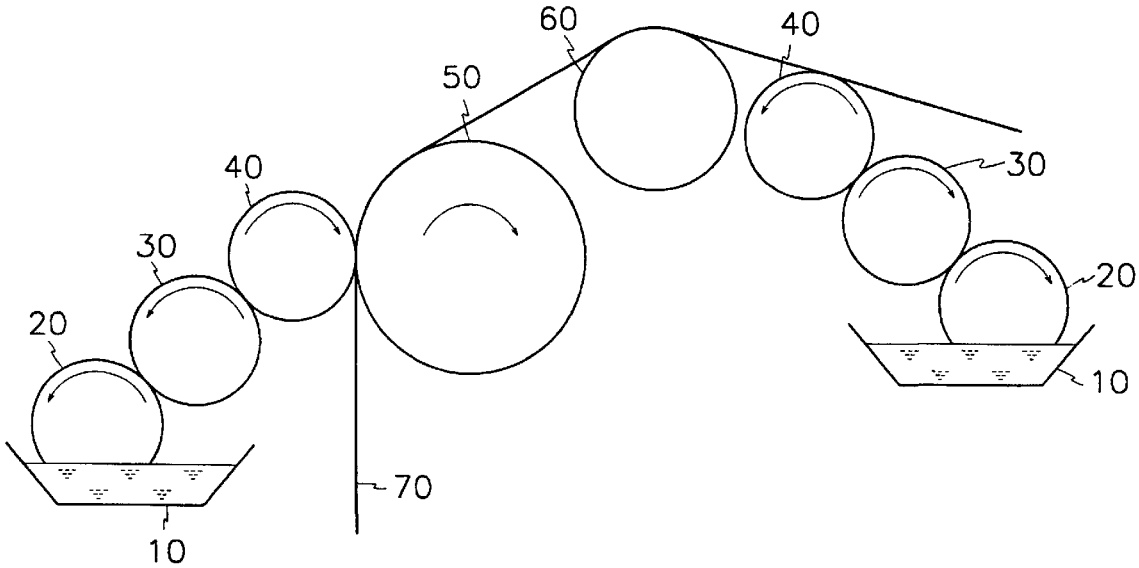
FIG. 2 is a schematic view of a device for processing the surface-treated steel sheet according to the present invention.

As shown in FIG. 2, the chromate treatment using the triple roll coater is made by getting a pick-up roll 20 stained with the chromate solution contained in a drip pan 10, transfering the solution to a transfer roll 30 with the pick-up roll 20, applying the solution onto a zinc or zinc-based alloy plated steel sheet with an applicator roll 40, and drying the applied solution. In the drawing, non-described reference numerals 50, 60 and 70 indicate a back-up roll, a lift roll and steel sheet respectively.

The amount of deposition of the chromate film can be changed by controlling the rotating direction, rotational speed, or pressure of the rolls.

The amount of chrome (Cr) in the chromate film is preferably in the range of 20–250 g/m$^2$. This is based on the amount of the chromate coating at drying. The amount of 20 g/m$^2$ is a minimum value for achieving improvement in corrosion resistance. When the amount is larger than 250 g/m$^2$, production cost increases, and chrome elutes, deteriorating physical properties of the chromate film.

The chromate film-coated steel sheet is baked to harden the chromate film. The baking temperature is preferably in the range of 120–250° C. In the temperature range, the hardening is fluently effected without occurrence of any crack.

Formation of Resin Coating Layer

The resin solution for forming the resin coating layer is typically prepared from a subject solution, colloidal silica and a hardening agent. An agent for facilitating the hardening effect, lubricant, and metallic powder may be selectively added to the resin solution.

Phenoxy resin is preferably used as the subject solution. Acryl, epoxy or urethane may be also used for that purpose.

The phenoxy resin can serve to enhance cosmetic corrosion resistance and fuel corrosion resistance because it has a higher glass transition temperature Tg than 100° C. that is common to other resins.

Even if the ambient temperature around the fuel tank is higher than 100° C., the molecular chains of the phenoxy resin do not make a microbrown movement and, therefore, do not bear distortion in molecular chains. This property of phenoxy resin makes it possible to prevent intrusion of water or gasoline content, thereby strengthening corrosion resistance.

The molecular weight of phenoxy resin is preferably in the range of 25,000–50,000. When the molecular weight is lower than 25,000, the desired corrosion resistance cannot be satisfactorily obtained. In contrast, when the molecular weight is higher than 50,000, it is impossible to synthesize phenoxy resin.

Colloidal silica is added to the resin solution to improve corrosion resistance of the resulting resin coating layer. As phenoxy resin is basic, colloidal silica having the same property is selected among other silica.

When the phenoxy resin content is determined to be 100, the amount of addition of colloidal silica is preferably in the range of 10–20 phr (parts per hundred resin). This range is established to fluently effect improvement in corrosion resistance.

Melamine resin is added to the phenoxy resin solution as the hardening agent. The melamine resin receives heat during the coating process and reacts with hydroxylic group of phenoxy resin, thereby making the coating structure to be more compact. That is, with the addition of melamine resin, the linear structure of phenoxy resin is shifted into a net structure. In this structure, intrusion of the external corrosive molecules is prevented, thereby improving corrosion resistance.

The amount of addition of the melamine resin is preferably in the range of 2–15 phr with respect to the phenoxy resin content. When the amount is smaller than 2 phr, sufficient hardening effect cannot be achieved. When the amount is larger than 15 phr, cracks are produced in the resulting resin coating layer.

Organic acid-based para toluene sulfonic acid (hereinafter referred to as the "p-TSA") is used as the agent for facilitating the hardening effect. The p-TSA is to facilitate reactivity between phenoxy resin and melamine resin, thereby easily shifting the linear structure of the phenoxy resin into a net structure. With the addition of the p-TSA, the cross-linking density between phenoxy resin and the hardening agent is enhanced, and the physical properties of the resulting resin coating layer is improved.

The amount of addition of the p-TSA is preferably in the range of 0.3–1.0 phr with respect to the phenoxy resin content. The p-TSA enhances the hardening effect in proportional to the amount of addition in condition that the baking temperature is constant. However, when the amount is larger than 1.0 phr, the resin solution is hardened even in ambient temperature so that it becomes impossible to store the resin solution. When the amount is smaller than 0.3 phr, the desired facilitation of the hardening effect cannot be expected.

Wax is added to the phenoxy resin solution as the lubricant. When wax is absent, the resulting resin coating layer has a high coefficient of surface friction so that press formability is deteriorated. Therefore, it is preferable that small amount of wax is added to the phenoxy resin solution, thereby lowering the coefficient of surface friction of the resin coating layer. At least one of polyethylene-based wax, polypropylene-based wax, and fluorine-based wax is employed for the lubricant. The polyethylene-based wax is preferred because it is cost effective among others.

The amount of addition of wax is preferably in the range of 2–10 phr with respect to the phenoxy resin content. When the amount is smaller than 2 phr, the desired effect of lowering the coefficient of surface friction of the resulting resin coating layer cannot be satisfactorily obtained. In contrast, when the amount is larger than 10 phr, adherence of the resin coating layer to the chromate film is deteriorated.

At least one metallic powder selected from aluminum (Al), zinc (Zn), manganese (Mn), cobalt (Co), nickel (Ni), tin (Sn) or tin monooxide (SnO) is added to the resin solution to enhance weldability of the resulting surface-treated steel sheet. As the resin coating layer is in itself non-conductive, sparks may occur at welding or the welded portion may be easily released. Therefore, it is preferable that the metallic powder is intruded into the resin structure, and gives electrical conductivity thereto while keeping the shielding effect to be constant. This makes it possible to satisfy formability and corrosion resistance requirements at the same time. The metallic powder is preferably selected from conductive metals having both cosmetic corrosion resistance and fuel corrosion resistance.

The particle size and shape of the metallic powder are critical in achieving the desired improvement effects. The particle size of the metallic powder is preferably in the range of 0.5–5 $\mu$m. When the particle size is smaller than 0.5 $\mu$m, the dispersion degree of the resin solution is lowered, and secondary cohesion is generated, resulting in increased production cost. In contrast, when the particle size is larger than 5 $\mu$m, the weighty particles sediment in the resin solution and generate sludge. The sludge is protruded onto the resin coating layer, deteriorating formability.

It is preferable that the metallic powdered particles have a plate shape rather than a sphere shape in consideration of stability of the resin solution and conductivity of the resin coating layer. This is because the sphere-shaped particles are more easily precipitated in the resin solution than the plate-shaped particles. Furthermore, the plate-shaped particles more easily overlap than the sphere-shaped particles. In this respect, the plate-shaped particles have a role of path for electrical conduction. The thickness of the plate-shaped particles is preferably in the range of 0.1–0.5 $\mu$m.

The amount of addition of the metallic powder is preferably in the range of 5–30 phr with respect to the phenoxy resin content. When the amount is smaller than 5 phr, it cannot serve to enhance weldability. In contrast, when the amount is larger than 30 phr, storage of the resin solution is deteriorated, and adherence of the resin coating layer is also deteriorated.

When the prepared resin solution is deposited on the chromate film, the amount of deposition makes a great influence on weldability of the resulting surface-treated steel sheet. As the amount is excessively large, the resulting resin coating layer interrupts flowing of current during welding so that sparks are generated or weldability is deteriorated.

In consideration of such characteristics, the thickness of the resulting resin coating layer is preferably in the range of 1–10 $\mu$m. When the thickness is smaller than 1 $\mu$m, the desired improvement in cosmetic corrosion resistance and fuel corrosion resistance cannot be effected. In contrast, when the thickness is larger than 10 $\mu$m, further improvement effects are no longer produced and, instead, formability and weldability are deteriorated.

The technique of applying the resin solution onto the chromate film is the same as in the chromate treatment.

The resin-coated steel sheet is baked to harden the resin coating layer. The baking temperature is preferably in the range of 160–250° C. In such a range, fluent hardening effect can be expected.

In order to evaluate physicochemical and mechanical characteristics of the surface-treated steel sheet according to the present invention, measurement was performed with respect to the following aspects. The measurement was applied to the subsequently following examples.

Amount of Elution of Chrome Content from Chromate Film

The color difference, chrome content and chrome elution of various chromate films were compared with respect to trivalent chrome ions $Cr^{+3}$ and hexavalent chrome ions $Cr^{+6}$.

Cosmetic Corrosion Resistance

The cosmetic corrosion resistance is measured by using a salt spray test (SST). A sodium chloride (NaCl) solution of 5% is sprayed onto specimens of the surface-treated steel sheet under the conditions of 1 kg/m$^2$ of spraying pressure, 1 ml per hour of spraying amount, and 35° C. of testing temperature. The cosmetic corrosion resistance was evaluated respect to flat portions and bent portions separately. The flat portions are cut by a size of 75×150 mm and located at the salt water spray test equipment. The bent portions are punched by 95 mm Ø and formed into cups with a diameter of 50 mm and a height of 25 mm. Thereafter, the cups allowed to stand for 1,500 hours. Then, the cups were taken out, washed by distilled water, and dried. According to the ratio of rust occurrence, corresponding grades were determined and evaluated.

Alternatively, cyclic corrosion test (CCT) was also performed for measuring the cosmetic corrosion resistance. A sodium chloride solution was sprayed onto specimens for 4 hours. Thereafter, the specimens were dried for 4 hours at 60° C., and hygrometered for 18 hours at 95% of humidity and 50° C. The results were evaluated by one cycle per one day.

The SST techniques were performed according to Japanese Industrial Standard (JIS Z2371). According to the amount of occurrence of white and red rusts, the grades of cosmetic corrosion resistance were classified in the following way.

Circle in circle (◎): The volume of occurrence of white rust was 5% or less with respect to the total volume of the specimen.

Circle (○): The volume of occurrence of white rust was in the range of 5–30% with respect to the total volume of the specimen.

Square (□): The volume of occurrence of white rust was in the range of 30–50% with respect to the total volume of the specimen.

Triangle (Δ): The volume of occurrence of white rust was in the range of 50–100% with respect to the total volume of the specimen.

X: Red rust occurred.

Fuel Corrosion Resistance

Specimens of the surface-treated steel sheet were punched by 95 mm Ø, and formed into cups each with a diameter of 50 mm and a height of 25 mm. Three kinds of solutions were poured into the cups. Thereafter, the opening portions of the cups were covered with transparent glass plates by interposing circular "O" rings. The transparent glass plates were fixed to the cups via clamps to thereby prevent leakage of the solutions.

The solutions were classified into A type, B type and C type. For the A type solution, 95% of regular gasoline was mixed with 5% of sodium chloride (NaCl) aqueous solution. For the B type solution, 85% of regular gasoline was mixed with 14% of methanol containing 66 ppm of formic acid and $Cl^-$ ion, and 1% of distilled water. For the C type solution is 100% of regular gasoline.

In order to simulate driving situation of automobile, a rocking equipment was used such that the solution contained in the cup was in rocking motion.

The cups were allowed to stand for 6 months. Then, the cups were taken out, washed by distilled water, and dried. Thereafter, fuel corrosion resistance was tested with respect to the inner surface of the cups contacting the fuel. According to the amount of occurrence of white and red rusts, the grades of fuel corrosion resistance were classified in the following way.

Circle in circle (◎): The volume of occurrence of white rust was 5% or less with respect to the total volume of the specimen.

Circle (○): The volume of occurrence of white rust was in the range of 5–30% with respect to the total volume of the specimen.

Square (□): The volume of occurrence of white rust was in the range of 30–50% with respect to the total volume of the specimen.

Triangle (Δ): The volume of occurrence of white rust was in the range of 50–100% with respect to the total volume of the specimen.

X: Red rust occurred.

Chemical Resistance

Resin coating layers on the chromate-treated steel sheet were alternately lubricated with MEK twenty times. Six grades of desquamation and discoloration were determined and evaluated. The criteria of evaluation were as follows.

Circle in circle (◎): Desquamation did not occur, and color difference was in the range of Δ E 0.5 or less.

Circle (○): Desquamation did not occur, and color difference was in the range of Δ E 0.5–3.

Square (□): Desquamation did not occur, and color difference was in the range of Δ E 3 or more.

Triangle (Δ): Desquamation occurred by 30% or less of the resin coating layer.

X: Desquamation occurred by 50% or more of the resin coating layer.

Adherence of Resin Coating Layer

The inner surface of the surface-treated steel sheet to contact fuel may be directly used, but the outer surface of the surface-treated steel sheet to be exposed to the outside should be applied with paint coating to protect the resulting fuel tank from external factors such as impact of the stones bounced against it for driving. Therefore, it is important to secure stable adherence of the paint coating layer or the resin coating layer to the chromate-treated steel sheet.

In order to evaluate such an adherence characteristic, melamine resin is coated onto specimens of the surface-treated steel sheet, and then baked at 170° C. for 30 minutes such that the thickness of the dried resin coating layer was 500 $\mu$m. The specimens were immerged into distilled water for 240 hours, and then dried. Cross lines were drawn on the surface of the specimens to form one hundred of rectangular pieces spaced from one another with a distance of 2 mm. When scotch tapes were attached onto the surface of the specimen and detached therefrom, the desquamated pieces were enumerated to thereby evaluate the adherence characteristic.

Circle in circle (◎): The number of desquamated pieces was 1 or less.

Circle (○): The number of desquamated pieces was 1–10.

Square (□): The number of desquamated pieces was 10–25.

Triangle (Δ): The number of desquamated pieces was 25–50.

X: The number of desquamated pieces was 50 or more.

Stability of Resin Solution

When metallic powder was added to the resin solution, occurrence of sludge and abnormal condition of the resin solution are discriminated with naked eye, and evaluated to be either in a good state or in a poor state.

Coefficient of Friction

Formability of the surface-treated steel sheet was estimated by measuring its coefficient of friction. The surface-treated steel sheet was cut into a specimen with a size of 45×300 mm, and the coefficient of friction of the specimen was tested under the conditions of 0.27 kg/cm$^2$ of pressure and 1,000 mm/min of drawing speed, and computed by using the following equation 1. The criterion of evaluation was based on the values of the computed coefficient of friction.

$$\text{Coefficient of friction } (\mu) = Fd/Fn \quad 1)$$

where Fd is the drawing force, Fn the force normal to the specimen.

Circle in circle (◎): The coefficient of friction was in the range of 0.10 or less.

Circle (○): The coefficient of friction was in the range of 0.10–0.15.

Square (□): The coefficient of friction was in the range of 0.15–0.20.

Triangle (Δ): The coefficient of friction was in the range of 0.20–0.25.

X: The coefficient of friction was in the range of 0.25 or more.

Weldability

Spot welding and seam welding were made with respect to specimens of the surface-treated steel sheet.

The spot welding was carried out with an air compression welder (DAIHEN PRA-33A). The welding force was established to be 250 kgf, and the welding time to be 15 cycle where the welding was paused for 40 seconds per twenty spots. The tensional strength test was performed by the distance of 200 spots. The weldability was evaluated by the number of spots that are above the B grade of JIS Z 3140.

The seam welding was carried out with circular plate electrodes of copper alloy each having a diameter of 250 mm, a thickness of 15 mm and a width of 6.5 mm. The welding force was established to be 400 kgf, the welding current to be 16 kA, the welding time to be 2 cycles of current-on and 1 cycle of current-off, and the welding speed to be 1 m/min. The tensional strength test was performed with respect to the welded specimens.

The grades of weldability were classified in the following way.

Circle in circle (◎): Shearing tensional strength was in the range of 30 kg/mm$^2$ or more.

Circle (○): Shearing tensional strength was in the range of 25–30 kg/mm$^2$.

Triangle (Δ): Shearing tensional strength was in the range of 20–25 kg/mm$^2$.

X: Shearing tensional strength was in the range of 20 kg/mm$^2$ or less.

Examples 1–2 and Comparative Examples 1–10

The chromate solutions having the compositions listed in Table 1 were deposited on 20 g/m$^2$ of zinc-nickel (Zn—Ni) alloy plated steel sheets such that they were attached thereon by 20–250 mg/m$^2$, and baked at 120–250° C. Thereafter, the amount of elution of trivalent chrome ions $Cr^{+3}$ and hexavalent chrome ions $Cr^{+6}$ was measured. The results are listed in Table 2.

TABLE 1

| Chromate solution | Concentration of chrome (The ratio:0.5) (g/l) | Phosphoric acid (wt %) | Sulfuric acid (wt %) | Fluoric acid (wt %) | Colloidal silica (wt %) | Hardening agent (wt %) |
|---|---|---|---|---|---|---|
| Com. Ex. 1 | 24 | 60 | — | 25 | 800 | 30 |
| Ex. 1 | 24 | 60 | 6 | 25 | 800 | 30 |
| Com. Ex. 2 | 24 | — | 6 | 25 | 800 | 30 |
| Com. Ex. 3 | 24 | 60 | 6 | 25 | — | 30 |
| Com. Ex. 4 | 24 | 60 | 6 | — | 800 | 30 |
| Com. Ex. 5 | 24 | 60 | 6 | 25 | 800 | — |

TABLE 2

| Chromate film | Color difference (E) | Amount of chrome content (%) $Cr^{+3}$ | Amount of chrome content (%) $Cr^{+6}$ | Amount of chrome elution (%) |
|---|---|---|---|---|
| Com. Ex. 1 | 5.5~7.4 | 59~62 | 38~42 | 6.0~6.8 |
| Ex. 1 | 2.3~2.6 | 77~82 | 18~23 | 0.6~1.0 |
| Com. Ex. 2 | 5.7~5.9 | 88~74 | 26~32 | 17.1~19.3 |
| Com. Ex. 3 | 8.5~8.9 | 58~62 | 38~42 | 23.6~25.3 |
| Com. Ex. 4 | 8.3~8.9 | 64~69 | 31~36 | 17.2~18.8 |
| Com. Ex. 5 | 5.5~8.4 | 61~86 | 34~39 | 31.0~40.0 |

As indicated in Table 2, the chromate film according to Example (Ex.) 1 exhibited chrome elution prohibiting capacity better than those according to Comparative Examples (Com. Ex.) 1 to 5. It was assumed that this is because the chromate film according to Example 1 has insoluble trivalent chrome ions $Cr^{+3}$ greater than soluble hexavalent chrome ions $Cr^{+6}$, and the insoluble trivalent chrome ions effectively prohibit elution of chrome.

Furthermore, the chromate film according to Example 1 was excellent in surface color difference before and after being immersed in boiling water.

The chromate solution having the composition according to Example 1 was applied onto a zinc-nickel (Zn—Ni) alloy plated steel sheet, and baked. Thereafter, the surface-treated steel sheet was evaluated in terms of cosmetic corrosion resistance and fuel corrosion resistance. Chromate solutions used in Comparative Examples 7 and 8 were those having compositions disclosed in Japanese Patent Laid Open Publication No. Hei9-59783. The results are listed in Table 3.

TABLE 3

| Surface-treated steel sheets | Surface treatment | CCR SST(720 hr) Flat | CCR SST(720 hr) Bent | CCR CCT (30 cycle) Flat | CCR CCT (30 cycle) Bent | FCR (one month) |
|---|---|---|---|---|---|---|
| Com. Ex. 6 | Fused Pb—Sn alloy plated (105 g/m$^2$) steel sheet | Δ | ⊙ | x | x | ○ |
| Ex. 2 | Zn—Ni alloy electroplated (20 g/m$^2$) and chromate treated (80 mg/m$^2$) steel sheet | ⊙ | ⊙ | ⊙ | ○ | ⊙ |
| Com. Ex. 7 | Zn plated (40 g/m$^2$) and chromate treated (30–50 g/m$^2$) steel sheet | x | x | x | x | Δ |
| Com. Ex. 8 | Zn—Ni alloy electroplated (20 g/m$^2$)steel sheet | x | x | x | x | x |
| Com. Ex. 10 | Zn plated (40 g/m$^2$) and chromate treated (10 mg/m$^2$) steel sheet | x | x | x | x | x |

(CCR: Cosmetic corrosion resistance, FCR: Fuel corrosion resistance)

As indicated in Table 3, the surface-treated steel sheets according to Example 2 exhibited good cosmetic corrosion resistance and markedly improved fuel corrosion resistance.

Examples 3–17 and Comparative Examples 11–39

A chromate solution having the composition according to Example 1 of table 1 was applied onto a zinc (Zn) plated steel sheet to form a chromate film thereon, and a resin solution having a composition in Table 4 was applied onto the chromate film to form a resin coating layer thereon, thereby fabricating a surface-treated steel sheet. In the same way, several other surface-treated steel sheets were fabricated while varying the compositions of the resin solution within the scope of the present invention. The resulting surface-treated steel sheets were evaluated in terms of chemical resistance, cosmetic corrosion resistance, fuel corrosion resistance and adherence of the resin coating layer to the chromate film.

The amount of zinc (Zn) in the zinc plating layer was 20–80 g/m$^2$. The amount of chrome (Cr) of the chromate film was 50 mg/m$^2$ when the chromate coating was baked at 160° C. after the chromate treatment.

The resin solution was prepared by adding 15 phr (20 nm of particle diameter) of colloidal silica (Product No. snowtex-N of Nissin Chemical Corporation) to 100 of phenoxy resin (Product No. PKHW-35 of Union carbide corporation) while varying the compositions of melamine resin for the hardening agent.

The resin solution was applied onto the chromate-treated steel sheet, and baked at 190° C. to thereby fabricate a surface-treated steel sheet with a resin coating layer.

The physicochemical characteristics of the surface-treated steel sheets with different compositions of the hardening agent were tested, and the results are given in Table 4.

TABLE 4

| Surface-treated steel sheet | Treatment: Amount of plating (g/m$^2$) | Treatment: Amount of coating (mg/m$^2$) | Composition of resin solution: Subject solution | Hardening agent: Kind | Hardening agent: Content (phr) | Hardening agent: Silica | Evaluation: CR | Evaluation: CCR | Evaluation: FCR A-type | Evaluation: FCR B-type | Evaluation: Adherence |
|---|---|---|---|---|---|---|---|---|---|---|---|
| C.Ex.11 | Zn | Cr | Epoxy | Amide | 0 | Colloidal | Δ | Δ | x | Δ | ⊙ |
| C.Ex.12 | 20–80 | 50 | resin | resin | 2 | silica | Δ | □ | □ | ○ | ⊙ |
| C.Ex.13 | | | | | 5 | 15(phr) | ⊙ | ⊙ | □ | ○ | ○ |
| C.Ex.14 | | | | | 10 | | ○ | ○ | ○ | ⊙ | ⊙ |
| C.Ex.15 | | | Epoxy- | Melamine | 0 | | x | x | x | x | ⊙ |
| C.Ex.16 | | | urethane | resin | 2 | | Δ | Δ | x | Δ | ⊙ |
| C.Ex.17 | | | resin | | 5 | | Δ | Δ | Δ | □ | ⊙ |
| C.Ex.18 | | | | | 10 | | Δ | Δ | Δ | □ | ⊙ |
| C.Ex.19 | | | Epoxy- | Iso- | 0 | | x | Δ | x | Δ | ⊙ |
| C.Ex.20 | | | ester | cyanate | 2 | | Δ | □ | Δ | □ | ⊙ |
| C.Ex.21 | | | resin | | 5 | | □ | ○ | □ | ○ | ⊙ |
| C.Ex.22 | | | | | 10 | | ○ | ○ | ○ | ⊙ | ⊙ |
| C.Ex.23 | | | Phenoxy | Melamine | 0 | | Δ | □ | □ | ○ | ⊙ |
| Ex. 3 | | | resin | resin | 2 | | ○ | ○ | ○ | ⊙ | ⊙ |
| Ex. 4 | | | | | 5 | | ⊙ | ⊙ | ⊙ | ⊙ | ⊙ |
| Ex. 5 | | | | | 10 | | ⊙ | ⊙ | ⊙ | ⊙ | ⊙ |
| Ex. 6 | | | | | 15 | | ⊙ | ⊙ | ⊙ | ⊙ | ⊙ |
| C.Ex.24 | | | | | 20 | | ○ | ○ | ○ | ⊙ | ⊙ |
| C.Ex.25 | | | | No resin treatment | | | — | □ | Δ | ○ | ⊙ |
| C.Ex.26 | Pb—Sn 60 | Cr 10 | | No resin treatment | | | — | ○ | ○ | ⊙ | □ |
| C.Ex.27 | Zn 20 | Cr 40 | | No resin treatment | | | — | x | Δ | ○ | ⊙ |

TABLE 4-continued

| Surface-treated steel sheet | Treatment: Amount of plating ($g/m^2$) | Treatment: Amount of coating ($mg/m^2$) | Composition of resin solution: Subject solution | Hardening agent: Kind | Hardening agent: Content (phr) | Hardening agent: Silica | Evaluation: CR | Evaluation: CCR | Evaluation: FCR A-type | Evaluation: FCR B-type | Evaluation: Adherence |
|---|---|---|---|---|---|---|---|---|---|---|---|
| C.Ex.28 | Al 60 | — | | No resin treatment | | | — | ◎ | ◎ | ◎ | x |

(C.Ex.: Comparative Example, CR: Chemical resistance)

It can be noted from Table 4 that the surface-treated steel sheets with a resin coating layer exhibited cosmetic corrosion resistance and fuel corrosion resistance better than the surface-treated steel sheets without suffering any resin treatment. Among the applied resins, epoxy-urethane resin and epoxy-ester resin exhibited poor chemical characteristics compared to epoxy resin. Furthermore, phenoxy resin exhibited excellent chemical characteristics among other resins and, therefore, was evaluated to be most appropriate for use in the resin treatment.

Phenoxy resin exhibited varying chemical characteristics according to the amount of addition of melamine resin for the hardening agent. As indicated in Table 4, the amount of addition of melamine resin is preferably in the range of 2–15 phr.

In view of the above results, appropriate resin solutions were selected and chromate-treated steel sheet was applied with such resin solutions. The chemical characteristics of the resin solutions as a function of the thickness of the resulting resin coating layer were evaluated. The results are given in Table 5.

As indicated in Table 5, when melamine resin was not added to phenoxy resin, the chemical characteristics of the resin coating layer were not nearly changed even in varying the thickness of the resin coating layer. Furthermore, it turned out that when the thickness of the resin coating layer was in the range of 1–10 $\mu$m, the chemical characteristics of the resin coating layer were most excellent. When the thickness of the resin coating layer was 10 $\mu$m or more, the chemical resistance was deteriorated due to insufficient drying of the resin coating during the baking process.

In view of the above experimental results, resin coating layers were formed on chromate-treated steel sheets such that they have a thickness of 3 $\mu$m. The chemical characteristics of the resin coating layers as a function of the baking temperature were evaluated. The results are given in Table 6.

TABLE 5

| | Composition of resin solution: Subject solution | Hardening agent: Kind | Hardening agent: Content (phr) | Silica (phr) | TRC ($\mu$m) | Evaluation: CR | Evaluation: CCR | Evaluation: FCR A-type | Evaluation: FCR B-type | Evaluation: Adherence |
|---|---|---|---|---|---|---|---|---|---|---|
| C. Ex.29 | Phenoxy | Melamine | 0 | Colloidal | 1 | Δ | Δ | Δ | □ | ◎ |
| C. Ex.30 | Resin | resin | | Silica | 2 | Δ | □ | □ | ○ | ◎ |
| C. Ex.31 | 100 | | | 15 | 10 | x | ○ | □ | ◎ | ◎ |
| C. Ex.32 | | | | | 12 | x | ○ | ○ | ◎ | ◎ |
| C. Ex.33 | | | 2 | | 1 | ○ | ○ | □ | ◎ | ◎ |
| Ex. 7 | | | | | 2 | ◎ | ◎ | ◎ | ◎ | ◎ |
| Ex. 8 | | | | | 10 | ◎ | ◎ | ◎ | ◎ | ◎ |
| C. Ex.34 | | | | | 12 | ○ | ◎ | ◎ | ◎ | ◎ |
| C. Ex.35 | | | 5 | | 1 | ○ | ○ | □ | ◎ | ◎ |
| Ex. 9 | | | | | 2 | ◎ | ◎ | ◎ | ◎ | ◎ |
| Ex. 10 | | | | | 10 | ◎ | ◎ | ◎ | ◎ | ◎ |
| C. Ex.36 | | | | | 12 | ○ | ◎ | ◎ | ◎ | ◎ |
| C. Ex.37 | | | 10 | | 1 | ○ | ○ | ○ | ◎ | ◎ |
| Ex. 11 | | | | | 2 | ◎ | ◎ | ◎ | ◎ | ◎ |
| Ex. 12 | | | | | 10 | ◎ | ◎ | ◎ | ◎ | ◎ |
| C. Ex.38 | | | | | 12 | ○ | ◎ | ◎ | ◎ | ◎ |

(TRC: Thickness of resin coating layer)

TABLE 6

| | Composition of resin solution | | | Baking | Evaluation | | | |
|---|---|---|---|---|---|---|---|---|
| | Subject solution | Hardening agent(phr) | Silica (phr) | temperature (MT.° C.) | CR | CCR | FCR (A-type) | Adherence |
| C. Ex. 39 | Phenoxy | Melamine | Colloidal | 140 | □ | ○ | □ | ◎ |
| Ex. 13 | resin | resin | silica | 160 | ◎ | ◎ | ◎ | ◎ |
| Ex. 14 | 100 | 5 | 16 | 180 | ◎ | ◎ | ◎ | ◎ |
| Ex. 15 | | | | 200 | ◎ | ◎ | ◎ | ◎ |
| Ex. 16 | | | | 220 | ◎ | ◎ | ◎ | ◎ |
| Ex. 17 | | | | 250 | ◎ | ◎ | ◎ | ◎ |

It can be noted from Table 6 that the chemical characteristics of the resin coating layer is most excellent when the baking temperature of the resin coating layer is in the range of 160–250° C.

Examples 18–32 and Comparative Examples 40–55

A cold-rolled steel sheet was sequentially overlaid with a zinc-nickel (Zn—Ni) plating layer and a chromate film to thereby fabricate a surface-treated steel sheet. The physicochemical characteristics of the surface-treated steel sheet were evaluated while varying the amount of addition of hardening facilitating agent contained in the resin solution.

The amount of deposition of zinc-nickel (Zn—Ni) alloy was established to be 40 g/m$^2$ while making the nickel content to be 12 wt %. The chromate solution having the composition according to Example 1 of table 1 was applied onto the zinc-nickel (Zn—Ni) alloy plated steel sheet, and baked at 190° C. to form a chromate film such that the amount of chrome (Cr) in the film should be 50 mg/m$^2$.

The resin solution was prepared by adding 5 phr of melamine resin (Product No. Cymel 325 of Cytec Corporation) for the hardening agent and 15 phr (20 nm of particle diameter) of colloidal silica (Product No. snowtex-N of Nissin Chemical Corporation) to 100 of phenoxy resin (Product No. PKHW-35 of Union Carbide Corporation; average molecular weight of 50,000 in water diffusion). The p-TSA was added to the resin solution while varying its content.

The prepared resin solutions were applied onto chromate-treated steel sheets, baked at 190° C., and water-cooled to thereby fabricate surface-treated steel sheets with a resin coating layer having a thickness of 1–10 μm.

The physicochemical characteristics of the surface-treated steel sheets as a function of variance in contents of p-TSA were evaluated, and the results are given in Table 7.

TABLE 7

| | Treatment | | Composition of resin solution | | | | | | Evaluation | | | | | |
|---|---|---|---|---|---|---|---|---|---|---|---|---|---|---|
| | Amount of plating (g/m$^2$) | Amount of coating (mg/m$^2$) | Subject solution | Hardening agent (phr) | Silica (phr) | HFA Kind | HFA Con (phr) | TRC (μm) | CR | CCR | FCR A-type | FCR B-type | FCR C-type | Adherence |
| CEx40 | Zn—Ni | Cr | Phenoxy | Melamin | Colloi | p- | 0 | 1 | ○ | Δ | Δ | □ | ○ | ◎ |
| CEx41 | | | | | | | | 2 | ◎ | □ | □ | ○ | ○ | ◎ |
| CEx42 | | | | | | | | 5 | ◎ | ○ | □ | ○ | ◎ | ◎ |
| CEx43 | | | | | | | | 10 | ◎ | ○ | ○ | ○ | ◎ | ◎ |
| CEx44 | | | | | | | 0.3 | 1 | ◎ | ○ | ○ | ○ | ◎ | ◎ |
| Ex. 18 | | | | | | | | 2 | ◎ | ○ | ○ | ◎ | ◎ | ◎ |
| Ex. 19 | | | | | | | | 5 | ◎ | ◎ | ◎ | ◎ | ◎ | ◎ |
| CEx45 | | | | | | | | 10 | ◎ | ◎ | ◎ | ◎ | ◎ | ◎ |
| CEx46 | | | | | | | 0.6 | 1 | ◎ | ○ | ○ | ○ | ◎ | ◎ |
| Ex. 20 | | | | | | | | 2 | ◎ | ◎ | ◎ | ◎ | ◎ | ◎ |
| Ex. 21 | | | | | | | | 5 | ◎ | ◎ | ◎ | ◎ | ◎ | ◎ |
| CEx47 | | | | | | | | 10 | ◎ | ◎ | ◎ | ◎ | ◎ | ◎ |
| CEx48 | | | | | | | 1.0 | 1 | ◎ | ○ | ○ | ○ | ◎ | ◎ |
| Ex. 22 | | | | | | | | 2 | ◎ | ◎ | ◎ | ◎ | ◎ | ◎ |
| Ex. 23 | | | | | | | | 5 | ◎ | ◎ | ◎ | ◎ | ◎ | ◎ |
| CEx49 | | | | | | | | 10 | ◎ | ◎ | ◎ | ◎ | ◎ | ◎ |
| CEx50 | | | | | | | 1.5 | 1 | ◎ | □ | □ | ○ | ◎ | ◎ |
| Ex. 24 | | | | | | | | 2 | ◎ | ◎ | ◎ | ◎ | ◎ | ◎ |
| Ex. 25 | | | | | | | | 5 | ◎ | ◎ | ◎ | ◎ | ◎ | ◎ |
| CEx51 | | | | | | | | 10 | ◎ | ◎ | ◎ | ◎ | ◎ | ◎ |

(CEX: Comparative Example, HFA: Hardening facilitating agent, Con: Content)

As indicated in Table 7, it turned out that the chemical resistance, cosmetic corrosion resistance and fuel corrosion resistance of the surface treated steel sheet were improved when the content of p-TSA was 0.3 phr or more with respect to the phenoxy resin content. In contrast, when the content of p-TSA was 1.0 phr or more, such improvement effects were not produced. Furthermore, they were improved when the thickness of the resin coating layer was 1 μm or more.

When the resin solution containing the p-TSA was applied onto chromate-treated steel sheets, and baked, the chemical characteristics of the surface-treated steel sheets with a resin coating layer were tested, and the results are given in Table 8.

TABLE 8

| | Surface treatment | | | Baking | Evaluation | | | |
|---|---|---|---|---|---|---|---|---|
| | Zn–Ni ($g/m^2$) | Cr ($mg/m^2$) | Resin | (MT.° C.) | CR | CCR | FCR(A) | Adherence |
| Com.Ex.52 | 40 | 50 | Phenoxy resin: 100 | 140 | ○ | ○ | ○ | ◎ |
| Ex. 26 | | | Colloidal silica: 15(phr) | 160 | ◎ | ◎ | ◎ | ◎ |
| Ex. 27 | | | Melamine resin: 5(phr) | 180 | ◎ | ◎ | ◎ | ◎ |
| Ex. 28 | | | p-TSA: 0.5(phr) | 200 | ◎ | ◎ | ◎ | ◎ |
| Ex. 29 | | | | 220 | ◎ | ◎ | ◎ | ◎ |
| Ex. 30 | | | | 250 | ◎ | ◎ | ◎ | ◎ |

As indicated in Table 8, when the baking temperature was higher, the chemical resistance, cosmetic corrosion resistance and fuel corrosion resistance of the surface-treated steel sheets were improved as much. However, when the baking temperature was 160° C. or more, the chemical characteristics of the surface-treated steel sheets were no longer improved.

Resin solutions containing the p-TSA were applied onto chromate-treated steel sheets to fabricate surface-treated steel sheets with a resin coating layer. The weldability of the surface-treated steel sheets as a function of the thickness of the resin coating layer were tested, and the results are given in Table 9.

The amount of deposition of zinc-nickel (Zn—Ni) alloy was established to be 30 $g/m^2$ while making the nickel content to be 12 wt %. The chromate solution having the composition according to Example 1 of Table 1 was applied onto the zinc-nickel (Zn—Ni) alloy plated steel sheet, and baked at 180° C. to form a chromate film such that the amount of chrome (Cr) in the film should be 50 $mg/m^2$.

The resin solution was prepared by adding 0–15 phr of melamine resin (Product No. Cymel 325 of Cytec Corporation) for the hardening agent and 15 phr (20 nm of particle diameter) of colloidal silica (Product No. snowtex-N of Nissin Chemical Corporation) to 100 of phenoxy resin (Product No. PKHW-35 of Union Carbide Corporation;

TABLE 9

| | Surface treatment | | | TRC | Evaluation |
|---|---|---|---|---|---|
| | Zn–Ni($g/m^2$) | Cr($mg/m^2$) | Resin | (μm) | Weldability(Continuous spots) |
| Com.Ex.53 | 40 | 50 | Phenoxy resin: 100 | 1 | 1,500 |
| Ex. 31 | | | Colloidal silica: 15(phr) | 2 | 800 |
| Ex. 32 | | | Melamine resin: 5(phr) | 5 | 200 |
| Com.Ex.54 | | | p-TSA: 0.5(phr) | 10 | Non-conduction(Failure) |
| Com.Ex.55 | | | | 15 | Non-conduction(Failure) |

As indicated in Table 9, when the thickness of the resin coating layer increases, the weldability of the surface-treated steel sheets is deteriorated as much. Therefore, when the resin coating is performed with the resin solution having the composition according to Examples 31 and 32, the thickness of the resin coating layer is preferably 5 μm or less.

Examples 33–45 and Comparative Examples 56–66

A cold-rolled steel sheet was sequentially overlaid with a zinc-nickel (Zn—Ni) plating layer and a chromate film to thereby fabricate a surface-treated steel sheet. The physicochemical characteristics of the surface-treated steel sheet were evaluated while varying the kind and amount of addition of wax contained in the resin solution.

average molecular weight of 50,000 in water diffusion). Wax was added to the resin solution while varying its kind and amount of addition.

The prepared resin solutions were applied onto chromate-treated steel sheets, baked at 190° C., and water-cooled to thereby fabricate surface-treated steel sheets with a resin coating layer having a thickness of 0.6–7 μm.

The physicochemical characteristics of the surface-treated steel sheets as a function of variance in the kind and amount of addition of wax were evaluated, and the results are given in Table 10.

TABLE 10

| | Composition of resin solution | | | | | | Condition | | Evaluation | | | | | |
|---|---|---|---|---|---|---|---|---|---|---|---|---|---|---|
| | | HA | | Wax | | | | | | | CCR | | FCR | |
| | SS | Kind | Con (phr) | Kind | Con (phr) | Silica (phr) | Baking (MT-° C.) | TRC (μm) | CF | CR | Flat | Bent | (A-type) | Adherence |
| C. Ex. 56 | Phenoxy resin 100 | Melamine resin | 0 | Polyethylene | 2 | Colloidal silica 15 | 180 | 3 | Δ | Δ | Δ | Δ | Δ | ◎ |
| Ex. 33 | | | 2 | | | | | 3 | ◎ | ◎ | ◎ | ◎ | ◎ | ◎ |
| Ex. 34 | | | 15 | | | | | 3 | ◎ | ◎ | ◎ | ◎ | ◎ | ◎ |
| C. Ex. 57 | | | 5 | | | | | 0.6 | ◎ | ○ | ○ | Δ | □ | ◎ |
| Ex. 35 | | | | | | | | 1 | ◎ | ◎ | ◎ | ◎ | ◎ | ◎ |
| Ex. 36 | | | | | | | | 7 | ○ | ◎ | ◎ | ◎ | ◎ | ◎ |
| Ex. 38 | | | | | | | | 8 | ○ | ○ | ◎ | ◎ | ◎ | ○ |
| C. Ex. 58 | | | | | | | 140 | 3 | Δ | □ | ○ | □ | □ | □ |
| Ex. 38 | | | | | | | 160 | 3 | ◎ | ◎ | ◎ | ◎ | ◎ | ◎ |
| Ex. 39 | | | | | | | 250 | 3 | ◎ | ◎ | ◎ | ◎ | ◎ | ◎ |
| C. Ex. 59 | | | | | | | 270 | 3 | ◎ | ◎ | ◎ | ◎ | ◎ | ◎ |
| C. Ex. 60 | | | | — | — | | 180 | 2 | Δ | ◎ | ○ | × | × | ◎ |
| C. Ex. 61 | | | | Polyethylene | 1 | | 200 | 3 | □ | ◎ | ○ | □ | □ | ◎ |
| Ex. 40 | | | | | 2 | | | | ◎ | ◎ | ◎ | ◎ | ◎ | ◎ |
| Ex. 41 | | | | | 10 | | | | ◎ | ◎ | ◎ | ◎ | ◎ | ○ |
| C. Ex. 62 | | | | | 15 | | | | ◎ | ◎ | ◎ | ◎ | ◎ | × |
| C. Ex. 63 | | | | Poly- | 1 | | | | □ | ◎ | ○ | □ | □ | ◎ |
| Ex, 42 | | | | propylene | 5 | | | | ◎ | ◎ | ◎ | ◎ | ◎ | ◎ |
| Ex. 43 | | | | | 10 | | | | ◎ | ◎ | ◎ | ◎ | ◎ | ○ |
| C. Ex. 64 | | | | | 15 | | | | ◎ | ◎ | ◎ | ◎ | ◎ | × |
| C. Ex. 65 | | | | Fluorine | 1 | | | | □ | ◎ | ○ | □ | □ | ◎ |
| Ex. 44 | | | | based | 2 | | | | ◎ | ◎ | ◎ | ◎ | ◎ | ◎ |
| Ex. 45 | | | | | 10 | | | | ◎ | ◎ | ◎ | ◎ | ◎ | ○ |
| C. Ex. 66 | | | | | 15 | | | | ◎ | ◎ | ◎ | ◎ | ◎ | × |

(SS: Subject solution, HA: Hardening agent, CF: Coefficient of friction)

As indicated in Table 10, the physicochemical characteristics of the resin were influenced by the amount of addition of wax rather than the kind of wax. When the amount of addition of wax was small, the coefficient of friction was so high that the cosmetic corrosion resistance became poor after the processing. It turned out that as the amount of addition of wax increased, the coefficient of friction decreased as much.

However, when the amount of addition of wax was larger than 10 phr, adherence of the resin coating layer to the chromate film was deteriorated. The amount of addition was preferably in the range of 2–10 phr.

The baking temperature was preferably in the range of 160–250° C.

Examples 46–68 and Comparative Examples 67–93

A cold-rolled steel sheet was sequentially overlaid with a zinc-nickel (Zn—Ni) plating layer and a chromate film. A resin solution was applied onto the chromate film to form a resin coating layer thereon. The physicochemical characteristics of the resulting surface-treated steel sheet with a resin coating layer were evaluated while varying the kind and amount of addition of wax and metallic powder of the resin solution.

The amount of deposition of zinc-nickel (Zn—Ni) alloy was established to be 30 g/m$^2$ while making the nickel content to be 12 wt %. A chromate solution where the ratio of trivalent chrome ions $Cr^{+3}$ was 0.5 was applied onto the zinc-nickel (Zn—Ni) alloy plated steel sheet, and baked at 180° C. to form a chromate film such that the amount of chrome (Cr) in the film should be 50 mg/m$^2$.

The chromate solution was prepared by adding 30 wt % of solution containing 10 wt % of phepoxy-based silane for a hardening agent to a subject solution containing a chrome aqueous solution where the ratio of trivalent chrome ions $Cr^{+3}$ was 0.5. The chrome aqueous solution was prepared by adding 100 wt % of colloidal silica, 30 wt % of fluoric acid, 50 wt % of phosphoric acid and 10 wt % of sulfuric acid with respect to the chrome content to a solution of 29 g/l of chrome concentration.

The compositions of phenoxy resin, colloidal silica and melamine resin for the resin solution listed in Table 10 were used, but the kind and amount of addition of wax and metallic powder were differentiated. The resin treatment was the same as in Examples 33 to 45.

The physicochemical characteristics of the surface-treated steel sheets as a function of the amount of addition of the hardening agent and metallic powder of tin (Sn) in the resin solution were evaluated, and the results are given in Table 11.

TABLE 11

| | Composition of resin solution | | | | | | | | Evaluation | | | | | | | |
|---|---|---|---|---|---|---|---|---|---|---|---|---|---|---|---|---|
| | | HA | | | | | | Stability of | | Weld | | CCR | | FCR | | |
| | SS | Kind | Content (phr) | Wax (phr) | MP | Baking (° C.) | TRC (μm) | resin | CR | ability | CR | Flat | Bent | A | B | Adherence |
| C.Ex.67 | Phenoxy | Melamine | 0 | Poly- | Sn | 180 | 3 | Good | Δ | ○ | Δ | Δ | Δ | Δ | Δ | ◎ |
| Ex. 46 | resin | resin | 2 | ethylene | 2(μm) | | 3 | Good | ◎ | ◎ | ◎ | ◎ | ◎ | ◎ | ◎ | ◎ |
| Ex. 47 | 100 | | 5 | 2 | 10(phr) | | 3 | Good | ◎ | ◎ | ◎ | ◎ | ◎ | ◎ | ◎ | ◎ |
| Ex. 48 | | | 15 | | | | 3 | Good | ○ | ◎ | ◎ | ◎ | ◎ | ◎ | ◎ | ◎ |
| C.Ex.68 | | | | | | | 0.5 | Good | ◎ | ◎ | ○ | ○ | Δ | □ | Δ | ◎ |
| Ex. 49 | | | 5 | | | | 1 | Good | ◎ | ◎ | ◎ | ◎ | ◎ | ◎ | ◎ | ◎ |
| Ex. 50 | | | | | | | 10 | Good | ○ | ○ | ◎ | ◎ | ◎ | ◎ | ◎ | ◎ |
| C.Ex.69 | | | | | | | 12 | Good | Δ | Δ | ○ | ◎ | ◎ | ◎ | ◎ | ○ |
| C.Ex.70 | | | | | | 140 | 3 | Good | Δ | Δ | □ | ○ | □ | □ | Δ | ○ |
| Ex. 51 | | | | | | 160 | 3 | Good | ◎ | ◎ | ◎ | ◎ | ◎ | ◎ | ◎ | ◎ |
| Ex. 52 | | | | | | 250 | 3 | Good | ◎ | ◎ | ◎ | ◎ | ◎ | ◎ | ◎ | ◎ |
| C.Ex.71 | | | | | | 270 | 3 | Good | ◎ | ◎ | ◎ | ◎ | ◎ | ◎ | ◎ | ◎ |

(MP: Metallic powder)

As indicated in Table 11, the physicochemical characteristics of the resin solution were greatly differentiated according to the amount of addition of melamine resin for the hardening agent. The amount of addition of melamine resin was preferably in the range of 2–15 phr. However, even in the presence of appropriate amount of melamine resin, cosmetic corrosion resistance and fuel corrosion resistance were deteriorated when the thickness of the resin coating layer was 0.5 μm. Furthermore, when the thickness of the resin coating layer was larger than 10 μm, chemical resistance is deteriorated due to insufficient baking, and formability of the resin coating layer is also deteriorated.

When the baking temperature of the resin coating layer was 160° C. or less, the physicochemical characteristics were wholly deteriorated. In contrast, when the temperature was 250° C. or more, the desired improvement was no longer effected.

The physicochemical characteristics of the surface-treated steel sheets as a function of the amount of addition of wax and aluminum powder were evaluated, and the results are given in Table 12.

TABLE 12

| | Composition of resin solution | | | | | | | | Evaluation | | | | | | | |
|---|---|---|---|---|---|---|---|---|---|---|---|---|---|---|---|---|
| | | | Wax | | | | | Stability of | | | | CCR | | FCR | | |
| | SS | HA (phr) | Kind | Content (phr) | MP | Baking (° C.) | TRC (μm) | resin | CF | Wb | CR | Flat | Bent | A | B | Adherence |
| C.Ex.72 | Phenoxy | Mel- | — | — | Al | 200 | 3 | Good | Δ | ○ | ◎ | ○ | x | x | Δ | ◎ |
| C.Ex.73 | resin | amine | Car- | 1 | 1(μm) | | | Good | □ | ○ | ○ | ○ | x | x | Δ | ◎ |
| C.Ex.74 | 100 | resin | nuber | 5 | 15(phr) | | | Good | ○ | ○ | ◎ | ◎ | □ | ○ | ○ | ○ |
| C.Ex.75 | | 5 | | 10 | | | | Good | ○ | ○ | ◎ | ◎ | ◎ | ◎ | ◎ | □ |
| C.Ex.76 | | | | 15 | | | | Good | ○ | ○ | ◎ | ◎ | ◎ | □ | Δ | x |
| C.Ex.77 | | | Poly- | 1 | | | | Good | □ | ○ | ◎ | ○ | □ | □ | ○ | ◎ |
| Ex. 53 | | | ethylene | 2 | | | | Good | ◎ | ◎ | ◎ | ◎ | ◎ | ◎ | ◎ | ◎ |
| Ex. 54 | | | | 10 | | | | Good | ◎ | ◎ | ◎ | ◎ | ◎ | ◎ | ◎ | ○ |
| C.Ex.78 | | | | 15 | | | | Good | Δ | ○ | ◎ | ◎ | ◎ | □ | Δ | x |
| C.Ex.79 | | | Poly- | 1 | | | | Good | □ | ○ | ◎ | ○ | □ | □ | ○ | ◎ |
| Ex. 55 | | | propy- | 5 | | | | Good | □ | ◎ | ◎ | ◎ | ◎ | ◎ | ◎ | ◎ |
| Ex. 56 | | | lene | 10 | | | | Good | ◎ | ◎ | ◎ | ◎ | ◎ | ◎ | ◎ | ○ |
| C.Ex.80 | | | | 15 | | | | Good | ◎ | ○ | ◎ | ◎ | ◎ | ◎ | ◎ | x |
| C.Ex.81 | | | Fluorine | 1 | | | | Good | □ | ○ | ◎ | ○ | □ | □ | ○ | ◎ |
| Ex. 57 | | | based | 2 | | | | Good | ◎ | ◎ | ◎ | ◎ | ◎ | ◎ | ◎ | ◎ |
| Ex. 58 | | | | 10 | | | | Good | ◎ | ◎ | ◎ | ◎ | ◎ | ◎ | ◎ | ○ |
| C.Ex.82 | | | | 15 | | | | Good | ◎ | ○ | ◎ | ◎ | ◎ | ◎ | ◎ | X |

(Wb: Weldability)

As indicated in Table 12, the physicochemical characteristics of the surface-treated steel sheets were influenced by the amount of addition of wax rather than the kind of wax. When the amount of addition of wax was small, the coefficient of friction was so high that the cosmetic corrosion resistance was poor after processing. As the amount of addition of wax increased, the coefficient of friction decreased, and the corrosion resistance enhanced as much. However, when the amount of addition of wax was 15 phr or more, adherence of the resin coating solution to the chromate film was impaired.

The physicochemical characteristics of the surface-treated steel sheets as a function of the kind, size and amount of addition of metallic powder were evaluated, and the results are given in Table 13.

TABLE 13

| | Composition of resin solution | | | | | | | | Stability of resin | Evaluation | | | | | | | |
|---|---|---|---|---|---|---|---|---|---|---|---|---|---|---|---|---|---|
| | | | | Metallic powder | | | | | | | | | CCR | | FCR | | |
| | SS | HA (phr) | Wax (phr) | Kind | Size (μm) | Content (phr) | Baking (° C.) | TRC (μm) | | CF | Wb | CR | Flat | Bent | A | B | Adherence |
| C.Ex.83 | Phenoxy resin 100 | Melamine resin 5 | Polyethylene 10 | — | — | — | 200 | 2 | Good | Δ | Δ | ◎ | ◎ | ◎ | ◎ | ◎ | ◎ |
| C.Ex.84 | | | | Sn | 5–10 | 5 | | | Good | ◎ | Δ | ◎ | ◎ | ◎ | ◎ | ◎ | ○ |
| C.Ex.85 | | | | | | 10 | | | Poor | ◎ | ◎ | ◎ | ◎ | ◎ | ◎ | ◎ | ○ |
| C.Ex.86 | | | | | | 20 | | | Poor | ◎ | ◎ | ◎ | ◎ | ○ | ○ | ◎ | ○ |
| C.Ex.87 | | | | | | 30 | | | Poor | ○ | ◎ | ◎ | ○ | Δ | ○ | Δ | ○ |
| C.Ex.88 | | | | Al | 1–5 | 2 | | | Good | □ | Δ | ◎ | ○ | ○ | ○ | ○ | ◎ |
| Ex. 59 | | | | | | 5 | | | Good | ◎ | ◎ | ◎ | ◎ | ◎ | ◎ | ◎ | ◎ |
| Ex. 60 | | | | | | 30 | | | Good | ◎ | ◎ | ◎ | ◎ | ◎ | ◎ | ◎ | ◎ |
| C.Ex.89 | | | | | | 40 | | | Poor | ◎ | ◎ | ◎ | ◎ | Δ | Δ | Δ | ○ |
| C.Ex.90 | | | | Sn | 0.5–1.0 | 3 | | | Good | □ | Δ | ◎ | ○ | ○ | ○ | ○ | ◎ |
| Ex. 61 | | | | | | 10 | | | Good | ◎ | ◎ | ◎ | ◎ | ◎ | ◎ | ◎ | ◎ |
| Ex. 62 | | | | | | 20 | | | Good | ◎ | ◎ | ◎ | ◎ | ◎ | ◎ | ◎ | ◎ |
| C.Ex.91 | | | | | | 35 | | | Poor | ◎ | ◎ | ◎ | ◎ | Δ | Δ | Δ | ○ |
| C.Ex.92 | | | | Zn | 2–3 | 4 | | | Good | □ | Δ | ◎ | ○ | ○ | ○ | ○ | ◎ |
| Ex. 63 | | | | | | 10 | | | Good | ◎ | ◎ | ◎ | ◎ | ◎ | ◎ | ◎ | ◎ |
| Ex. 64 | | | | | | 30 | | | Good | ◎ | ◎ | ◎ | ◎ | ◎ | ◎ | ◎ | ◎ |
| C.Ex.93 | | | | | | 35 | | | Poor | ◎ | ◎ | ◎ | ◎ | Δ | Δ | Δ | ○ |
| Ex. 65 | | | | Mn | 1–2 | 15 | | | Good | ◎ | ◎ | ◎ | ◎ | ◎ | ◎ | ◎ | ◎ |
| Ex. 66 | | | | Co | 1–2 | 15 | | | Good | ◎ | ◎ | ◎ | ◎ | ◎ | ◎ | ◎ | ◎ |
| Ex. 67 | | | | Ne | 2–3 | 10 | | | Good | ◎ | ◎ | ◎ | ◎ | ◎ | ◎ | ◎ | ◎ |
| Ex. 68 | | | | SnO | 0.5–1.0 | 15 | | | Good | ◎ | ◎ | ◎ | ◎ | ◎ | ◎ | ◎ | ◎ |

It can be noted from Table 13 that as the metallic powder content of the resin solution increases, the weldability enhances as much. The stability of the resin solution was poor when the particle diameter of the metallic powder is more of 5 μm or 10 μm. The stability of the resin solution was also influenced by the amount of addition of metallic powder. That is, when the amount of addition of metallic powder such as tin (Sn) and aluminum (Al) was 30 phr or more, the metallic powder was precipitated, and the stability of the resin solution was impaired. The particle size of the metallic powder was preferably in the range of 0.5–5 μm, and the amount of addition was preferably in the range of 5–30 phr.

In short, with the addition of appropriate amount of melamine resin, wax and metallic powder into the phenoxy resin solution, the chemical resistance, fuel corrosion resistance and cosmetic corrosion resistance of the resulting surface-treated steel sheet are improved, and the weldability and formability are also enhanced.

As described above, the surface-treated steel sheet for fuel tanks according to the present invention is free from lead that causes environmental problems. Furthermore, the surface-treated steel sheet with optimum amount of chromate film and resin coating layer has good chemical characteristics such as cosmetic corrosion resistance, fuel corrosion resistance and chemical resistance. With the addition of wax and metallic powder, the weldability and formability of the surface-treated steel sheet are also improved while maintaining the chemical characteristics.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A surface-treated steel sheet for fuel tanks comprising:

a cold-rolled steel sheet with a low carbon content;

a zinc (Zn) or zinc-based alloy plating layer formed on the steel sheet; and a chromate film coated on the zinc or zinc-based alloy plating layer, the chromate film being formed from a chromate solution, the chromate solution comprising a) a subject solution and b) an aqueous silane solution in an amount ranging from 5 to 50% by weight of the subject solution, wherein the subject solution comprises i) a chrome aqueous solution comprising trivalent chrome, the chrome having a concentration ranging from 5 to 50 g/l , wherein the ratio of trivalent chrome to the chrome content is in the range of 0.4 to 0.8, and ii) Phosphoric acid in an amount ranging from 20 to 150% by weight with respect to the chrome content, fluoric acid in an amount ranging from 10 to 100% by weight with respect to the chrome content, colloidal silica having pH of 2–5 in an amount ranging from 50 to 2000% by weight with respect to the chrome content, and sulfuric acid in an amount ranging from 5 to 30% by weight with respect to the chrome content; and the aqueous silane solution comprises Epoxy-based silane in an amount ranging from 2 to 10% by weight and has a pH of 2–3.

2. The surface-treated steel sheet of claim 1 wherein the amount of zinc in the zinc plating layer is in the range of 20–80 g/m$^2$.

3. The surface-treated steel sheet of claim 2 wherein the amount of chrome (Cr) in the chromate film coated on the zinc plating layer is in the range of 20–250 mg/m$^2$.

4. The surface-treated steel sheet of claim 1 wherein the zinc-based alloy is zinc-nickel (Zn—Ni) alloy containing 10–14% of nickel content, and the amount of zinc-nickel alloy in the zinc-nickel plating layer is 10–40 g/m$^2$.

5. The surface-treated steel sheet of claim 4 wherein the amount of chrome in the chromate film coated on the zinc-nickel alloy plating layer is 20–250 mg/m$^2$.

6. The surface-treated steel sheet of claim 1 wherein the ratio of the trivalent chrome ions is controlled by adding etylene glycole into chromic anhydride.

7. The surface-treated steel sheet of claim 1 wherein the pH of the aqueous solution is controlled by adding phosphoric acid into the aqueous solution.

8. The surface-treated steel sheet of claim 3 or 5 further comprising a resin coating layer formed on one side or both sides of the chromate film, the resin coating layer being formed from a resin solution, the resin solution comprising a) a phenoxy resin solution having a molecular weight of 25,000–50,000, b) colloidal silica of 10–20 phr with respect to the phenoxy resin content, and c) melamine resin of 2–15 phr with respect to the phenoxy resin content.

9. The surface-treated steel sheet of claim 8 wherein the resin coating layer has a thickness of 1–10 $\mu$m.

10. The surface-treated steel sheet of claim 8 wherein the resin solution further comprises para toluene sulfonic acid (p-TSA) of 0.3–1.0 phr with respect to the phenoxy resin content.

11. The surface-treated steel sheet of claim 8 wherein the resin solution further comprises at least one material selected from the group consisting of polyethylene-based resin, polypropylene-based resin and fluorine-based resin as a lubricating agent, the lubricating agent being 2–10 phr with respect to the phenoxy resin content.

12. The surface-treated steel sheet of claim 11 wherein the resin solution further comprises metallic powder of 5–30 phr with respect to the phenoxy resin content.

13. The surface-treated steel sheet of claim 12 wherein the metallic powder is at least one material selected from the group consisting of aluminum (Al), zinc (Zn), manganese (Mn), cobalt (Co), Nickel (Ni), tin (Sn), and tin monooxide (SnO).

14. The surface-treated steel sheet of claim 13 wherein the metallic powder has a particle size of 0.5–5 $\mu$m.

15. The surface-treated steel sheet of claim 14 wherein the particle of the metallic powder is plate-shaped, and the plate-shaped particle of the metallic powder has a thickness of 0.1–0.5 $\mu$m.

16. A method of fabricating a surface-treated steel sheet, the method comprising the steps of:

electroplating a cold-rolled steel sheet with zinc or zinc-based alloy; and coating a chromate film on the zinc or zinc-based alloy plating layer, the chromate film being formed from a chromate solution, the chromate solution comprising a) a subject solution and b) an aqueous silane solution in an amount ranging from 5 to 50% by weight of the subject solution, wherein the subject solution comprises i) a chrome aqueous solution comprising trivalent chrome, the chrome having a concentration ranging from 5 to 50 g/l , wherein the ratio of trivalent chrome to the chrome content is in the range of 0.4 to 0.8, and ii) Phosphoric acid in an amount ranging from 20 to 150% by weight with respect to the chrome content, fluoric acid in an amount ranging from 10 to 100% by weight with respect to the chrome content, colloidal silica having pH of 2–5 in an amount ranging from 50 to 2000% by weight with respect to the chrome content, and sulfuric acid in an amount ranging from 5 to 30% by weight with respect to the chrome content; and the aqueous silane solution comprises Epoxy-based silane in an amount ranging from 2 to 10% by weight and has a pH of 2–3.

17. The method of claim 16 further comprising the step of baking the chromate film at 120–250° C. performed after the coating step.

18. The method of claim 16 wherein the coating of the chromate film is performed with a triple roll coater.

19. The method of claim 16 further comprising the step of forming a resin coating layer on one side or both sides of the chromate film, the resin coating layer being formed from a resin solution, the resin solution comprising a) a phenoxy resin solution having a molecular weight of 25,000–50,000, b) colloidal silica of 10–20 phr with respect to the phenoxy resin content, and c) melamine resin of 2–15 phr with respect to the phenoxy resin content.

20. The method of claim 19 further comprising the step of baking the resin coating layer at 160–250° C. after coating.

21. The method of claim 19 wherein the resin coated layer is formed with a triple roll coater.

22. The method of claim 19 wherein the resin solution further comprises para toluene sulfonic acid (p-TSA) of 0.3–1.0 phr with respect to the phenoxy resin content.

23. The method of claim 19 wherein the resin solution further comprises at least one material selected from the group consisting of polyethylene-based resin, polypropylene-based resin and fluorine-based resin as a lubricating agent, the lubricating agent being 2–10 phr with respect to the phenoxy resin content.

24. The method of claim 19 wherein the resin solution further comprises metallic powder of 5–30 phr with respect to the phenoxy resin content.

25. The method of claim 24 wherein the metallic powder is at least one material selected from the group consisting of aluminum (Al), zinc (Zn), manganese (Mn), cobalt (Co), Nickel (Ni), tin (Sn), and tin monooxide (SnO), the metallic powder having a size of particle of 0.5–5 $\mu$m, the particle of the metallic powder being plate-shaped, the plate-shaped particle of the metallic powder having a thickness of 0.1–0.5 $\mu$m.

26. A surface treatment solution for use in manufacturing fuel tanks, the surface treatment solution comprising:

a chromate solution comprising a) a subject solution and b) an aqueous silane solution in an amount ranging from 5 to 50% by weight of the subject solution, wherein the subject solution comprises i) a chrome aqueous solution comprising trivalent chrome, the chrome having a concentration ranging from 5 to 50 g/l , wherein the ratio of trivalent chrome to the chrome content is in the range of 0.4 to 0.8, and ii) Phosphoric acid in an amount ranging from 20 to 150% by weight with respect to the chrome content, fluoric acid in an amount ranging from 10 to 100% by weight with respect to the chrome content, colloidal silica having pH of 2–5 in an amount ranging from 50 to 2000% by weight with respect to the chrome content, and sulfuric acid in an amount ranging from 5 to 30% by weight with respect to the chrome content; and the aqueous silane solution comprises Epoxy-based silane in an amount ranging from 2 to 10% by weight and has a pH of 2–3.

27. A surface treatment solution for use in manufacturing fuel tanks, the surface treatment solution comprising:

a resin solution comprising a) a phenoxy resin solution having a molecular weight of 25,000–50,000, b) colloidal silica of 10–20 phr with respect to the phenoxy resin content, and c) melamine resin of 2–15 phr with respect to the phenoxy resin content.

28. The surface treatment solution of claim 27 wherein the resin solution further comprises para toluene sulfonic acid (p-TSA) of 0.3–1.0 phr with respect to the phenoxy resin content.

29. The surface treatment solution of claim 27 wherein the resin solution further comprises at least one material selected from the group consisting of polyethylene-based resin, polypropylene-based resin and fluorine-based resin as a lubricating agent, the lubricating agent being 2–10 phr with respect to the phenoxy resin content.

30. The surface treatment solution of claim 27 wherein the resin solution further comprises metallic powder of 5–30 phr with respect to the phenoxy resin content.

31. The surface treatment solution of claim 30 wherein the metallic powder is at least one material selected from the group consisting of aluminum (Al), zinc (Zn), manganese (Mn), cobalt (Co), Nickel (Ni), tin (Sn), and tin monooxide (SnO), the metallic powder having a size of particle of 0.5–5 $\mu$m, the particle of the metallic powder being plate-shaped, the plate-shaped particle of the metallic powder having a thickness of 0.1–0.5 $\mu$m.

* * * * *